United States Patent [19]

Bramberger et al.

[11] 4,269,283

[45] May 26, 1981

[54] METHOD AND APPARATUS FOR ACOUSTICAL DAMPING OF PUNCHING MACHINES AND THE LIKE

[75] Inventors: Bo C. Bramberger, Lindome; Kurt G. Stenudd, Gothenburg, both of Sweden

[73] Assignee: Håkan Sallander, Tranemo, Sweden

[21] Appl. No.: 81,786

[22] Filed: Oct. 4, 1979

[30] Foreign Application Priority Data

Oct. 10, 1978 [SE] Sweden ..... 7810567

[51] Int. Cl.[3] ..... F16F 7/00; F01B 11/02; F01B 29/00

[52] U.S. Cl. ..... 181/207; 92/51; 92/85 B; 92/143

[58] Field of Search ..... 181/207-209, 181/230, 237, 296; 92/51-53, 85 B, 143

[56] References Cited

U.S. PATENT DOCUMENTS 2,618,122 11/1952 Gratzmuller ..... 92/52 X
4,026,192 5/1977 Noren et al. ..... 92/143 X

*Primary Examiner*—L. T. Hix

*Assistant Examiner*—Thomas H. Tarcza

*Attorney, Agent, or Firm*—Burns, Doane, Swecker & Mathis

[57] ABSTRACT

This invention has for its object to eliminate the problem of loud noise and violent vibrations in machines having transient force characteristics of the type appearing in punching or cutting presses.

According to the invention this is achieved by means of a damping device comprising a housing defining a chamber filled with a hydraulic fluid said fluid being pre-compressed by a first piston acted on by the force and said pre-compressing being carried out to a pressure corresponding the force to be dampened. Immediately before the force relief the force is arranged to act on a second piston of bigger cross sectional area said second piston preventing a too rapid force relief of the press frame due to the pre-compressed hydraulic fluid.

The force relief occurs rather slowly due to the fact that the hydraulic fluid trapped in the chamber is exhausted via control valve keeping the pressure in the chamber almost constant and only permitting a certain volume flow therefrom.

4 Claims, 6 Drawing Figures

Fig.4.
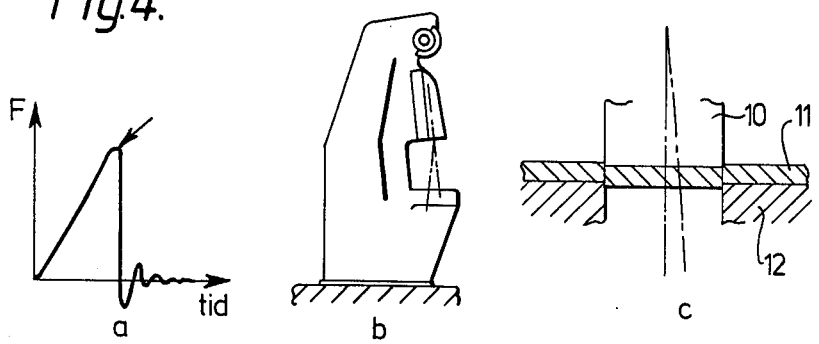
Fig.5.
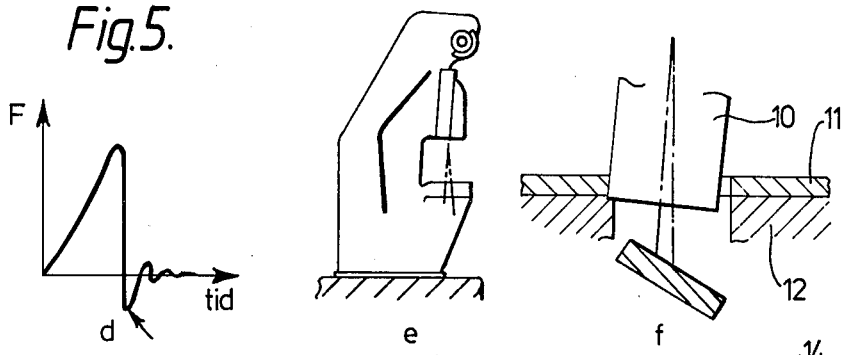
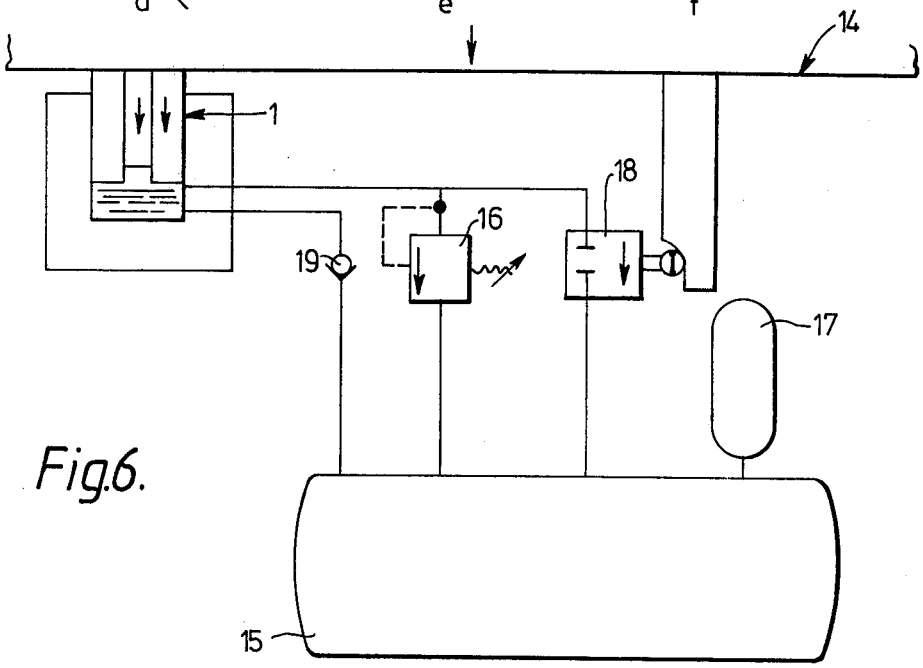
Fig.6.

METHOD AND APPARATUS FOR ACOUSTICAL DAMPING OF PUNCHING MACHINES AND THE LIKE

BACKGROUND AND SUMMARY OF THE PRESENT INVENTION

One of the most important problems regarding machines for stamping sheet metal is the loud noise and the vibrations created when the punch penetrates the sheet metal. This is due to the fact that the force acting on the punching tool is built up continuously until the penetration suddenly occurs and this force is usually of such a magnitude that the frame of the machine is stretched and regarding certain types of frames, brought to "yawn". Then, when the tool is penetrating the sheet metal this occurs suddenly and the frame resumes momentarily its original shape which produces the loud noise. The "yawning" also results in a certain displacement of the tool out of alignement which in turn results in that the punching will not be absolutely correct. Further, there will result an extra hard wearing of the punch and die.

The object of this invention is to eliminate these drawbacks and, according to the invention, this has been achieved by a method for damping noise and vibrations in machines having transient force-relieving of the type appearing in punching or cutting presses of the kinds indicated above and characterized in that the force is relieved slowly by having it pre-compress a hydraulic fluid trapped in a closed chamber the pre-compressing being carried out via a first piston to a predetermined pressure corresponding said force prior to relieving same, and by having the force then act on a second piston immediately before the force relief, whereafter, to obtain the slow force relief the hydraulic fluid is exhausted from the chamber through a line having a valve which is opened at a said predetermined pressure.

The invention also has an object to provide an apparatus for carrying the method into effect. This apparatus is charcterized by a housing defining a closed chamber, a first piston exposed to the force for pre-compressing a hydrualic fluid in the chamber, and by a second piston to be exposed to the force immediately before relieving said force and by one or more valve in an exhaust line from the chamber said valve being designed to open at a predetermined pressure.

Further aspects of the invention are disclosed in the sub-claims.

BRIEF DESCRIPTION OF THE DRAWINGS

The invention will be described more in detail below, reference being made to the accompanying drawings on which:

FIGS. 4 and 5 show a diagram a, a schematic view b of a press and a cross sectional view c of a punch, a die and a piece of sheet metal for illustrating the grounds of the noice generation.

FIG. 6 shows a scheme for the hydrualic lines of the inventive apparatus.

DETAILED DESCRIPTION OF THE PREFERRED EMBODIMENTS

Figure 1:
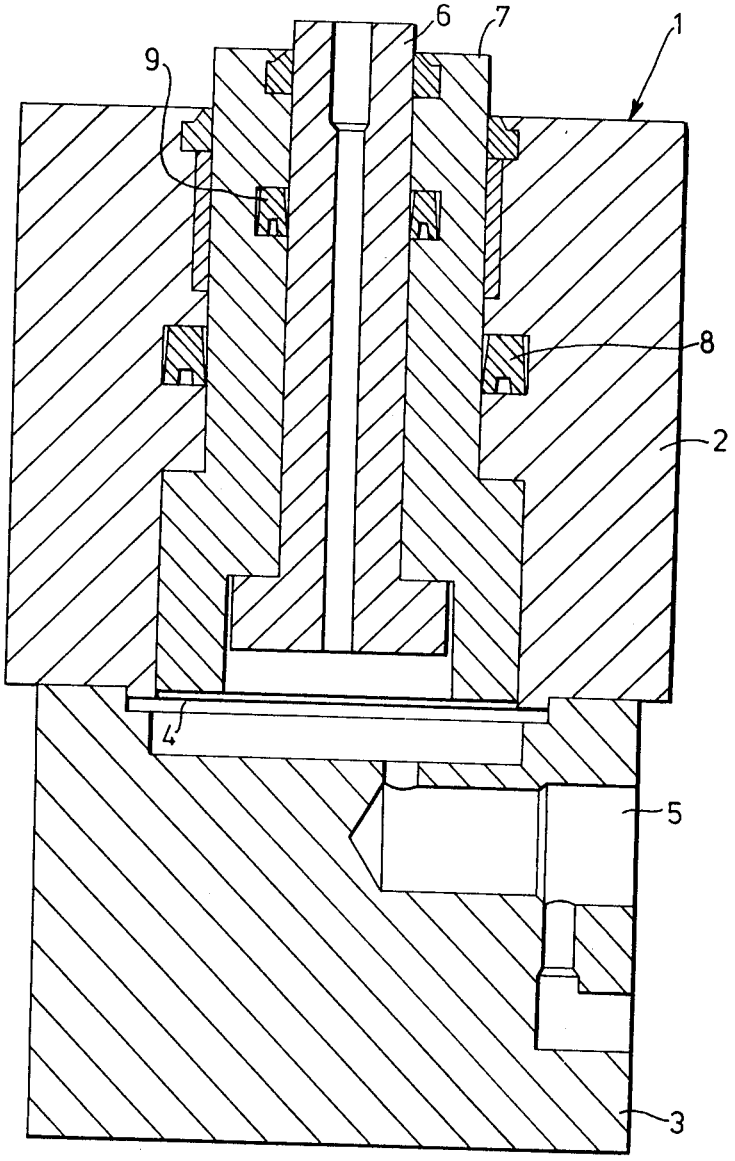
FIG. 1 shows a cross sectional view of the inventive apparatus.
Figure 2:
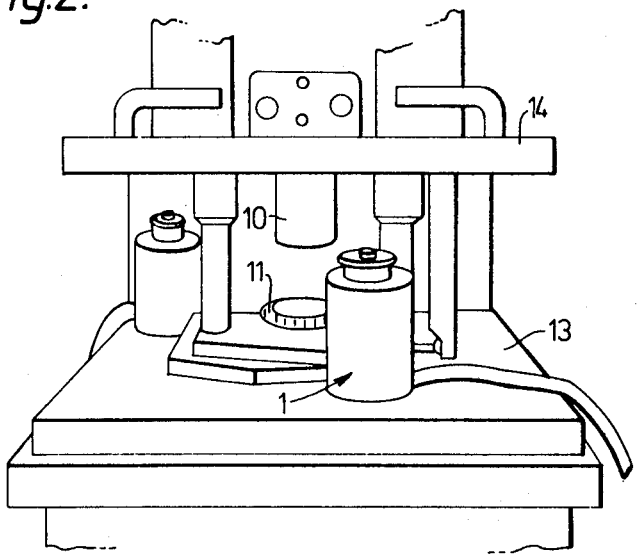
FIG. 2 the apparatus located at a tool in a first position.
Figure 3:
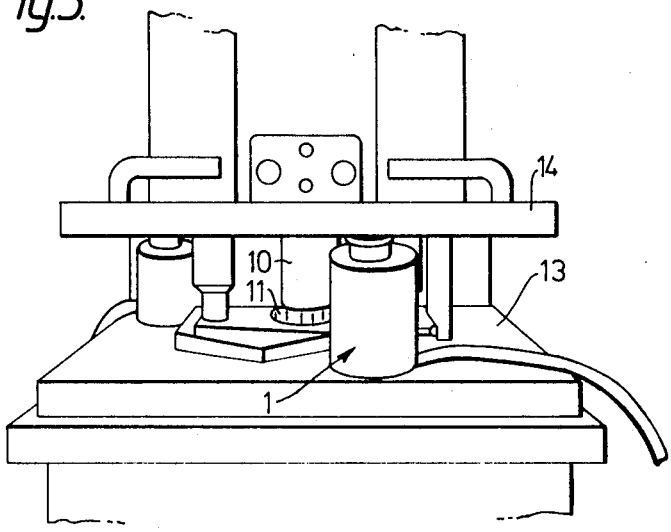
FIG. 3 the same apparatus as in FIG. 2 but in another position.

The inventive apparatus comprises a housing 1 having one upper 2 and one lower part 3. The parts 2 and 3 are together defining a chamber 4 to be filled with a hydraulic fluid, eg oil, supplied via the inlet 5. The upper part 2 of the housing 1 receives in a bore therein two coaxially arranged pistons 6 and 7. From these pistons the outer one 7 is displacable in the upper part 2 of the housing 1 and sealed thereto by sealing rings 8. The inner piston 6 is displacable in the outer piston and has a sealing ring 9.

In FIG. 4 there is shown the beginning of a stamping procedure and in diagram a there is shown how the stamping force increases to a maximum causing the frame to be deformed (to "yawn") as is shown in FIG. b and causing the punch 10 to start penetrating the work piece 11 supported on the die 12.

In FIG. 5 there is, in diagram d, illustrated the force curve for the punch 10 when piercing the work piece 11 (FIG. f) causing the deformation of the frame (the "yawning") to revert momentarily (FIG. e) whereby causing noise and vibrations to be generated. At the same time the punch 10 will come slightly out of alignment (FIG. f) so that the adverse effect indicated in FIG. 5 will result, namely the punch hitting the side surface defining the opening of the die which means excess wearing of the tool.

The purpose of the invention is to eliminate this drawbacks and this is achieved when at least two inventive devices 1 are placed on the table 13 of the press. When the slide 14 carrying the punch 10 is moving downwardly towards the work piece 11 the slide will hit the inner piston 6 of the damping device 1, the inner piston being displaced downwardly untill the upper surface thereof is level with the upper surface of the outer piston 7. This results in building up a certain pressure in the chamber 4 said pressure providing, via the pistons 6 and 7, a counter-force of about the same magnitude as the pressing-force so that, when the work piece is pierced (FIG. 5*f*), the pierceing will be less violent since the internal pressure of the damping device is counter-acting the spring forces of the press frame and prevents it from momentarily returning to its original shape.

When using the inventive damping device 1 it must be placed on the press table in such a way that the upper tool plate or the press slide 14 hits the outer piston 7 immediately before the punch breaks through the work piece 11. This can be accomplished in different ways, eg by making the height of the housing adjustable, by making the upper limit of the piston stroke adjustable or simply by placing washers or the like under the housing. Further, the inner piston 6 preferably has a stroke bigger than would be necessary which means that the predetermined pressure in the chamber 4 controlled by the valve 16 (in the order of 300–500 kp/cm$^2$) might be achieved before the upper surface of the inner piston is level with upper surface of the outer piston. Although this would cause a waste of energy this waste is of no importance as the counterforce excerted by the inner piston 6 on the slide 14 is small due to the small cross sectional area of this piston. However, when the upper surfaces of the pistons are level both pistons are acted on by the slide 14 which means that the counter-force now acting on the slide is much bigger and it is determined by the sum of the cross sectional areas of pistons and the predetermined pressure existing in the chamber. As this pressure can be adjusted by choosing a proper setting of the spring load of the valve 16 it is apparent that this counter force can be adjusted to a value almost equalling the elastic deformation force of the press frame so that the frame can only return to its original shape in a rate determined by the volume flow through the valve 16.

The position controlled relief valve 18 is not required but is preferred for use in such applications where the work piece is of considerable thickness and the stroke of the punch must continue a certain distance beyond the break-through point. Without this valve 18 there would be a considerable waste of energy as the punch during the whole stroke would be counter-acted by the damping devices 1. By relieving the pressure in the chambers 4 immediately after break through the counter-force acting on the slide 14 is decreased drastically and so is the energy waste.

FIG. 6 is a hydraulic circuit diagram showing the hydraulic lines of the inventive apparatus, the damping device 1 being shown only schematically and the slide 14 of the press being shown in abutting relationship with the damping device 1 of FIG. 1. The damping device 1 is connected to a reservoir 15 via lines having one pressure governing overflow valve 16, one position controlled relief valve 18 to be used when punching thick material to reduce the energy consumption after piercing the material, and one check value 19. Further, the reservoir 15 comprises a pressure accumulator 17.

The invention is not restricted to the embodiment shown and discribed but many modifications are possible within the scope of the following claims. This applies particularly to the hydraulic line system. An apparatus having the above function do not have its field of applications restricted to punching or cutting presses of the kind indicated above but can be used in other machines having a similar force curve. The function aimed at by the invention can be achieved with another number of pistons than has been mentioned above. Further, the pistons can be designed and placed in a way different from the described one.

We claim:

1. Method for damping noise and vibrations in machines having transient force relieving of the type appearing in punching or cutting presses comprising the steps of relieving the force slowly by pre-compressing a hydraulic fluid trapped in a closed chamber with a first piston to a pressure corresponding to said force prior to relieving the force, subjecting a second piston exposed to the hydraulic fluid to the force immediately before the force relief, and subsequently exhausting the hydraulic fluid from the chamber through a line having a valve which is opened at a predetermined pressure to obtain the slow force relief.

2. Apparatus for damping noise and vibrations in machines having transient force relieving of the type appearing in punching or cutting presses, comprising a housing defining a closed chamber, a first piston adapted to be exposed to the force for pre-compressing a hydraulic fluid in the chamber, a second piston exposed to the hydraulic fluid and adapted to be exposed to the force immediately before the force relief, and at least one valve in an exhaust line from the chamber, said valve being arranged to open at a predetermined pressure in the chamber.

3. Apparatus according to claim 2 further comprising a position controlled relief valve in the exhaust line, said relief valve being adapted to open at a certain position of a slide exerting said force on said pistons.

4. Apparatus according to claim 2 or 3 wherein the housing is of cylindrical shape, the second piston being arranged concentrically in said housing and the first piston being arranged concentrically in said second piston.

* * * * *